US011064828B1

(12) United States Patent
Joyner

(10) Patent No.: US 11,064,828 B1
(45) Date of Patent: Jul. 20, 2021

(54) ELEVATED DISHWARE HAVING FLATWARE RECEPTACLES

(71) Applicant: Michael Joyner, Delray Beach, FL (US)

(72) Inventor: Michael Joyner, Delray Beach, FL (US)

( * ) Notice: Subject to any disclaimer, the term of this patent is extended or adjusted under 35 U.S.C. 154(b) by 0 days.

(21) Appl. No.: 16/556,914

(22) Filed: Aug. 30, 2019

Related U.S. Application Data

(60) Provisional application No. 62/725,035, filed on Aug. 30, 2018.

(51) Int. Cl.
*A47G 19/08* (2006.01)
*A47G 21/14* (2006.01)

(52) U.S. Cl.
CPC ..... *A47G 19/08* (2013.01); *A47G 21/145* (2013.01)

(58) Field of Classification Search
CPC ..... A47G 19/08; A47G 21/145
USPC ..... 108/26
See application file for complete search history.

(56) References Cited

U.S. PATENT DOCUMENTS 37,046 A * 12/1892 Mackey
1,979,911 A * 11/1934 Steudel ..... A47G 19/02 108/91
3,565,245 A * 2/1971 Asher ..... A47G 1/14 206/229
4,127,189 A * 11/1978 Shumrak ..... B65D 1/34 206/520
4,662,676 A * 5/1987 Havelock ..... A47C 7/70 108/26
5,259,528 A * 11/1993 Pace ..... B65D 1/36 206/502
5,421,459 A * 6/1995 Mazzotti ..... A47G 19/065 206/549
5,860,367 A * 1/1999 Riegel ..... A47B 3/12 108/26
6,412,653 B1 * 7/2002 Waterhouse ..... B01F 13/002 206/542
6,732,990 B2 * 5/2004 Hudson ..... B60N 3/002 206/503
6,840,395 B2 * 1/2005 Agarwal ..... B65D 77/245 220/212
7,017,774 B2 * 3/2006 Haedt ..... B65D 1/28 206/564
D608,150 S * 1/2010 Lilly ..... D7/552.1
D660,659 S * 5/2012 Cohen ..... D7/629
D667,267 S * 9/2012 Kushner ..... D21/480
8,291,831 B2 * 10/2012 Spano ..... A01K 5/0135 108/25

(Continued)

*Primary Examiner* — Daniel J Troy
*Assistant Examiner* — Timothy M Ayres
(74) *Attorney, Agent, or Firm* — John Rizvi; John Rizvi, P.A.—The Patent Professor®

(57) ABSTRACT

A dishware combination comprising, at least, an elevating base and a plurality of receptacles for various flatware is disclosed. The combination may further comprise a plurality of flatware rests appropriate for spoons, forks, knives, chopsticks, or the like, and the plurality of receptacles may be specifically designed to accommodate flatware appropriate to the specific dishware combination implemented. The dishware combination itself may present as a soup bowl, salad plate, coffee plate or saucer, sushi plate, drinking glass, drinking mug, or any other type of dishware. The dishware combination may further comprise the appropriate flatware itself.

7 Claims, 7 Drawing Sheets

(56) References Cited

U.S. PATENT DOCUMENTS

| | | | | |
|---|---|---|---|---|
| 9,132,932 | B2 * | 9/2015 | Scharfe | A47G 19/2283 |
| 9,572,443 | B2 * | 2/2017 | Osborne | A47G 21/145 |
| 9,821,951 | B2 * | 11/2017 | Estabrook | A47J 31/407 |
| 10,413,034 | B2 * | 9/2019 | Teele | B65D 25/2888 |
| 10,633,155 | B2 * | 4/2020 | Sedgwick | B65D 43/163 |
| 2006/0118560 | A1 * | 6/2006 | Schur | A47G 19/12 220/508 |
| 2007/0113757 | A1 * | 5/2007 | Lilly | A47B 23/002 108/25 |
| 2007/0209527 | A1 * | 9/2007 | Yang | A23L 2/04 99/485 |
| 2009/0120942 | A1 * | 5/2009 | Vovan | B65D 43/0249 220/574.1 |
| 2018/0213979 | A1 * | 8/2018 | Dumler | A47G 29/093 |

* cited by examiner

ELEVATED DISHWARE HAVING FLATWARE RECEPTACLES

CROSS-REFERENCE TO RELATED APPLICATION

This application claims the benefit of U.S. Provisional Patent Application Ser. No. 62/725,035, filed Aug. 30, 2018, which is incorporated herein in its entirety.

FIELD OF THE INVENTION

The present invention relates generally to dishware, and more particularly, to a dishware combination comprising an elevating base and a plurality of receptacles for various flatware.

BACKGROUND OF THE INVENTION

It is common for individuals to use dishware and flatware. For example, dishware may be used as a receptacle or support surface for foods such as soups, stir-fries, or salads. Further, it is common for individuals to use flatware (i.e. eating utensils) as functional tools to consume food from dishware.

However, current dishware and flatware have various problems. For example, a user may enjoy consuming a soup using a spoon, but afterward the user may not have a hygienic place to put the spoon when they are taking a break from consuming the soup. Or further, a table may be initially set with a spoon on a table next to a bowl, and the table may not be a hygienic surface. This could ruin an individual's meal and potentially transmit illness.

Further, dishware and flatware can damage or leave a mark on a surface that they rest on while the dishware and flatware are being used. For example, a cold food item such as ice cream may cause a bowl in which it rests to leave rings of condensation on a surface. Alternatively, a soiled fork, spoon, or knife may soil a surface on which they rest.

Accordingly, there exists a need for an improved dishware system that solves the above described problems.

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments of the present disclosure, a dishware combination comprising an elevating base and a plurality of receptacles for various flatware is disclosed.

In another aspect, the dishware combination may comprise an x-shaped elevating base.

In another aspect, the dishware combination may comprise a plurality of spoon rests.

In another aspect, the dishware combination may comprise a plurality of knife rests.

In another aspect, the dishware combination may comprise a plurality of chopstick rests.

In another aspect, the dishware combination may comprise any of a variety of plates.

In another aspect, the dishware combination may comprise any of a variety of bowls.

In another aspect, the dishware combination may comprise any of a variety of saucers.

In another aspect, the dishware combination may comprise any of a variety of glasses.

In another aspect, the dishware combination may comprise any of a variety of mugs.

In another aspect, the dishware combination may comprise a plurality of appropriate flatware.

As yet another example, disclosed is Elevated dishware having flatware receptacles, comprising, a main body; one or more flatware receptacles, and an elevating base.

In another aspect, the flatware receptacles are located on a planar top surface of the main body.

In another aspect, the elevating base includes one or more projections extending from a bottom surface of the main body.

In another aspect, the flatware receptacles include a flatware rest that supports a curve of a flatware item placed in the flatware receptacle.

In another aspect, the elevating base generally has an "X" shape.

In another aspect, the flatware is a salad plate, and the main body comprises a horizontal planar surface with a dishware central cavity, the dishware central cavity comprising a shallow, rounded or squared cavity suitable for containing salad or other similar food items, the flatware receptacles being appropriately shaped to receive a plurality of flatware that is typically used with a salad plate.

In another aspect, the flatware is a coffee plate or saucer, the dishware main body comprising a horizontal planar surface with a dishware central cavity, the dishware central cavity comprising a shallow, rounded cavity, suitable for holding a coffee cup or other similar item, the plurality of flatware receptacles being appropriately shaped to receive a plurality of flatware that is typically used with a coffee plate or saucer.

In another aspect, the flatware is a sushi plate, the dishware main body comprising a horizontal planar surface with a dishware central cavity, the dishware central cavity comprising a shallow, squared cavity suitable for containing sushi or other similar food items, the plurality of flatware receptacles being appropriately shaped to receive a plurality of flatware that is typically used with a sushi plate.

In another aspect, the flatware is a drinking glass, the dishware main body comprising a vertical planar surface with a dishware central cavity, the dishware central cavity comprising a deep, cylindrical cavity suitable for containing drinkable fluids, the vertical planar surface further comprising a plurality of flatware receptacles, the plurality of flatware receptacles being appropriately shaped to receive a plurality of flatware that is typically used with a drinking glass.

In another aspect, the flatware is a drinking mug, the dishware main body comprising a vertical planar surface with a dishware central cavity, the dishware central cavity comprising a deep, cylindrical cavity suitable for containing drinkable fluids, the vertical planar surface comprising a drinking mug handle, the vertical planar surface further comprising a plurality of flatware receptacles appropriately shaped to receive a plurality of flatware that is typically used with a drinking mug.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIGS. 1 and 3. Furthermore, there is no intention to be bound by any expressed or implied theory presented in the preceding technical field, background, brief summary, or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
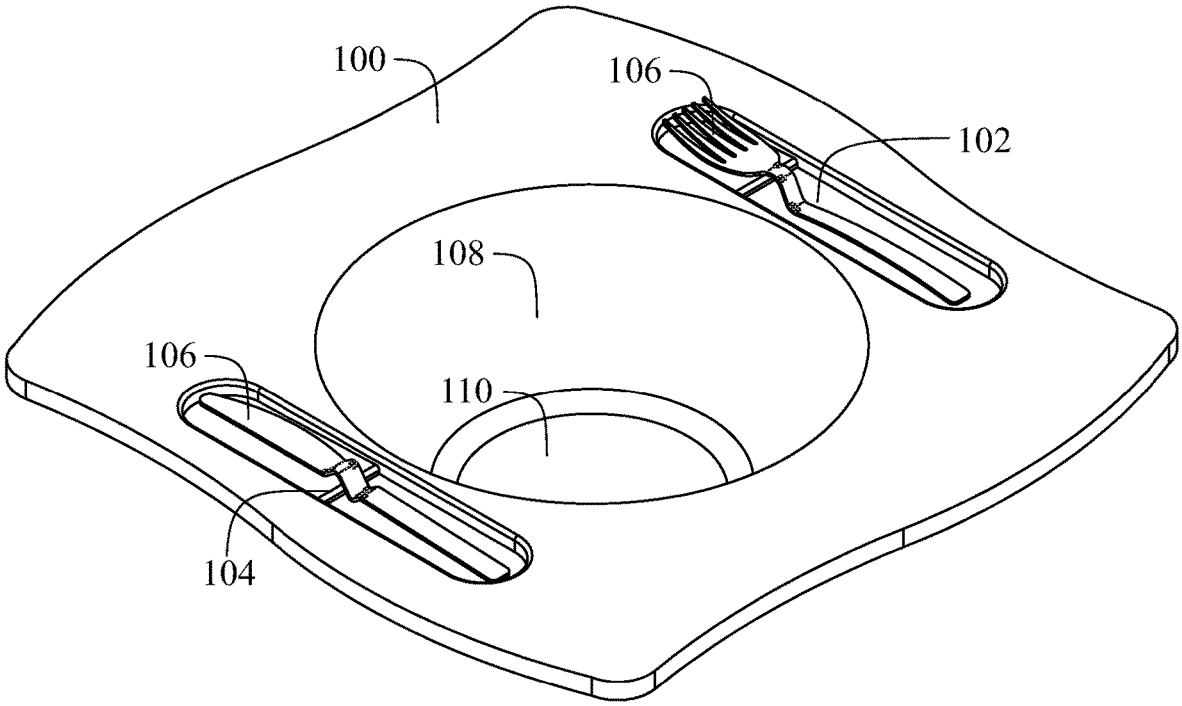
FIG. 1 presents a top perspective view of an exemplary dishware comprising an elevating base and a plurality of receptacles for flatware, and exemplary flatware thereon, in accordance with aspects of the present disclosure.
Figure 2:
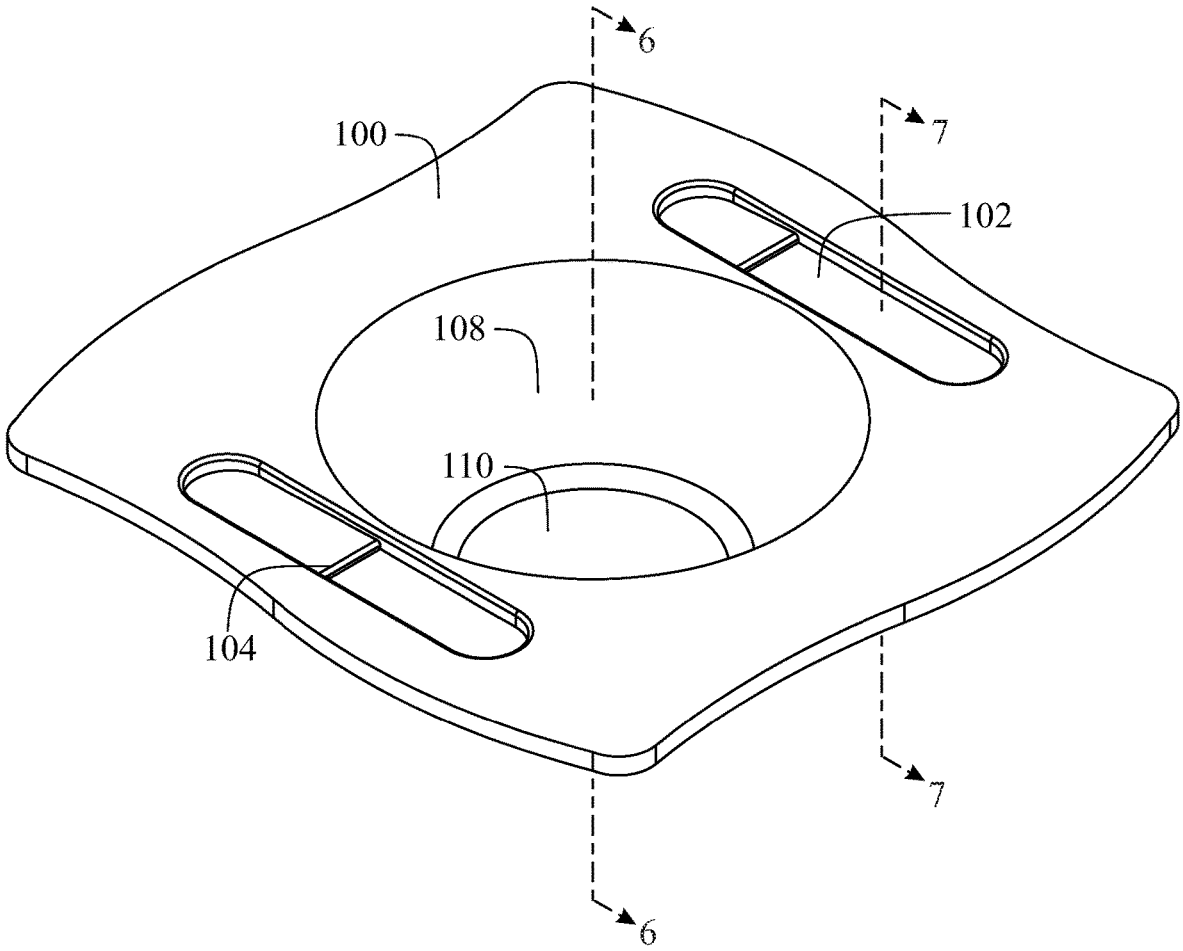
FIG. 2 presents a top perspective view of the exemplary dishware comprising an elevating base and a plurality of receptacles for flatware, in accordance with aspects of the present disclosure.
Figure 3:
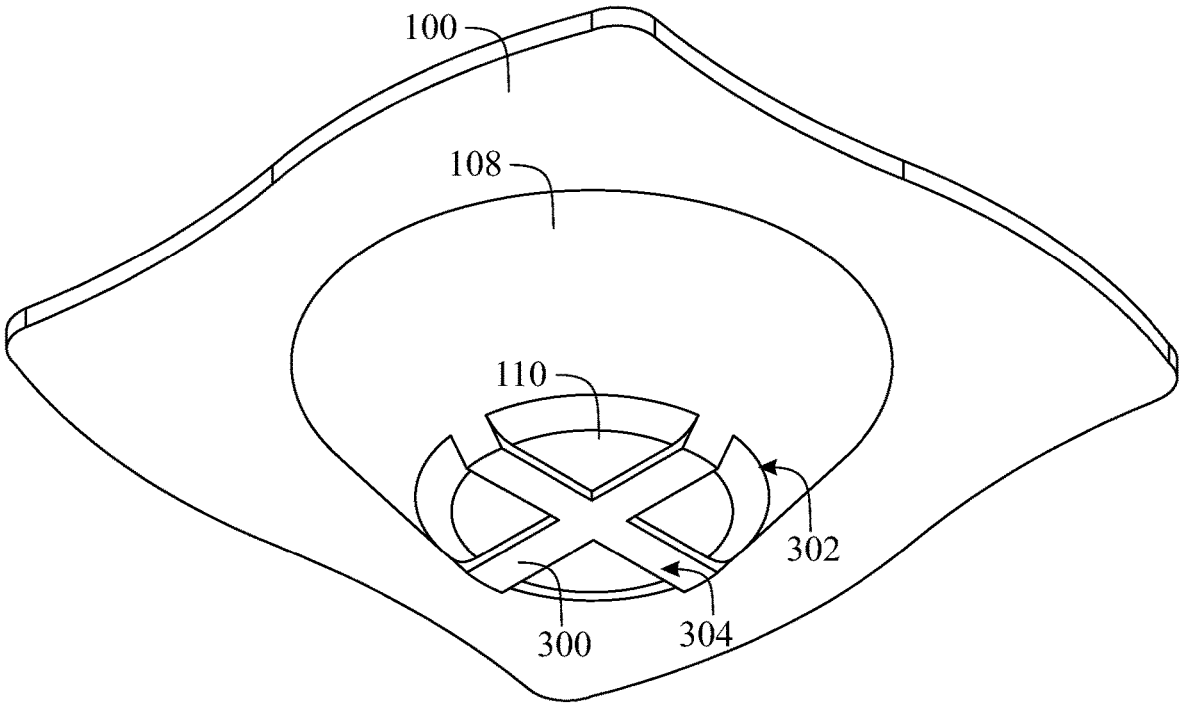
FIG. 3 presents a bottom perspective view of the exemplary dishware comprising an elevating base and a plurality of receptacles for flatware, in accordance with aspects of the present disclosure.

The illustrations of FIGS. 1-3 present a first example of a dishware combination comprising an elevating base and a plurality of receptacles for various flatware, and exemplary flatware thereon. Identified in the figures are a dishware main body 100, a plurality of flatware receptacles 102, a plurality of flatware rests 104, a plurality of flatware 106, a dishware central cavity 108, and a dishware base 110. As contemplated by the present disclosure, the dishware combination comprises, at least, the dishware main body 100, a plurality of flatware receptacles 102, the dishware central cavity 108, the dishware base 110, and the dishware support 300. It is to be understood that the flatware receptacles 102 may have any appropriate shape. For example, a flatware receptacle 102 may be a dip, a groove, or a sunken portion of a horizontal top planar surface shaped for holding an eating utensil.

In one example of the dishware combination, which may represent a soup bowl, the dishware main body 100 may comprise a horizontal top planar surface with a dishware central cavity 108. The dishware central cavity 108 may comprise a deep, rounded cavity suitable for containing soup or other similar fluids. The horizontal planar surface may further comprise a plurality of flatware receptacles 102, which may be located anywhere on the horizontal planar surface, but are preferentially located on opposing sides of the dishware central cavity 108. The dishware central cavity 108 comprises an upper edge and a lower edge, the upper edge mating with the horizontal planar surface and the lower edge mating with the dishware base 110. As shown in FIG. 3, the dishware base 110 comprises an upper side 302 and a lower side 304, the upper side 302 forming the bottom surface of the dishware central cavity 108 and the lower side 304 being attached to the dishware support 300. Turning back to FIG. 1, the plurality of flatware receptacles may be appropriately shaped to receive a plurality of flatware 106 that may be used with a soup bowl, such as a spoon, fork, or knife, and may further comprise a plurality of flatware rests 104 suited to the receiving of such plurality of flatware 106.

As shown in FIG. 3, the dishware support 300 may comprise additional material attached to or extruded from the dishware combination so as to form an "X" or a crossed pattern on the underside of the dishware combination. Such dishware support 300 may serve to insulate or elevate the dishware combination above a dining surface. It is to be understood that the dishware support may take any appropriate shape.

In another preferred example of the dishware combination, which may represent a salad plate, the dishware main body 100 may comprise a horizontal planar surface with a dishware central cavity 108. The dishware central cavity 108 may comprise a shallow, rounded or squared cavity suitable for containing salad or other similar food items. The plurality of flatware receptacles may be appropriately shaped to receive a plurality of flatware 106 that may be used with a salad plate, such as a spoon, fork, or knife, and may further comprise a plurality of flatware rests 104 suited to the receiving of such plurality of flatware 106.

In another preferred example of the dishware combination, which may represent a coffee plate or saucer, the dishware main body 100 may comprise a horizontal planar surface with a dishware central cavity 108. The dishware central cavity 108 may comprise a shallow, rounded cavity, having a smaller diameter than the salad plate above, suitable for holding a coffee cup or other similar item. The plurality of flatware receptacles may be appropriately shaped to receive a plurality of flatware 106 that may be used with a coffee plate or saucer, such as a stirring spoon, and may further comprise a plurality of flatware rests 104 suited to the receiving of such plurality of flatware 106.

In another preferred example of the dishware combination, which may represent a sushi plate, the dishware main body 100 may comprise a horizontal planar surface with a dishware central cavity 108. The dishware central cavity 108 may comprise a shallow, squared cavity suitable for containing sushi or other similar food items. The plurality of flatware receptacles may be appropriately shaped to receive a plurality of flatware 106 that may be used with a sushi plate, such as a spoon, fork, knife, or chopsticks, and may further comprise a plurality of flatware rests 104 suited to the receiving of such plurality of flatware 106.

In another preferred example of the dishware combination, which may represent a drinking glass, the dishware main body 100 may comprise a vertical planar surface with a dishware central cavity 108. The dishware central cavity 108 may comprise a deep, cylindrical cavity suitable for containing drinkable fluids. The vertical planar surface may further comprise a plurality of flatware receptacles 102, which may be located anywhere on the vertical planar surface, but are preferentially located on opposing sides of the dishware central cavity 108. The plurality of flatware receptacles may be appropriately shaped to receive a plurality of flatware 106 that may be used with a drinking glass, such as a stirring spoon or straw, and may further comprise a plurality of flatware rests 104 suited to the receiving of such plurality of flatware 106.

In another preferred example of the dishware combination, which may represent a drinking mug, the dishware main body 100 may comprise a vertical planar surface with a dishware central cavity 108. The dishware central cavity 108 may comprise a deep, cylindrical cavity, having a shorter height than the drinking glass above, suitable for containing drinkable fluids. The vertical planar surface may comprise a drinking mug handle. The vertical planar surface may further comprise a plurality of flatware receptacles 102, which may be located anywhere on the vertical planar surface, but are preferentially located on opposing sides of the dishware central cavity 108. The plurality of flatware receptacles may be appropriately shaped to receive a plurality of flatware 106 that may be used with a drinking mug, such as a stirring spoon or straw, and may further comprise a plurality of flatware rests 104 suited to the receiving of such plurality of flatware 106.

Figure 4:
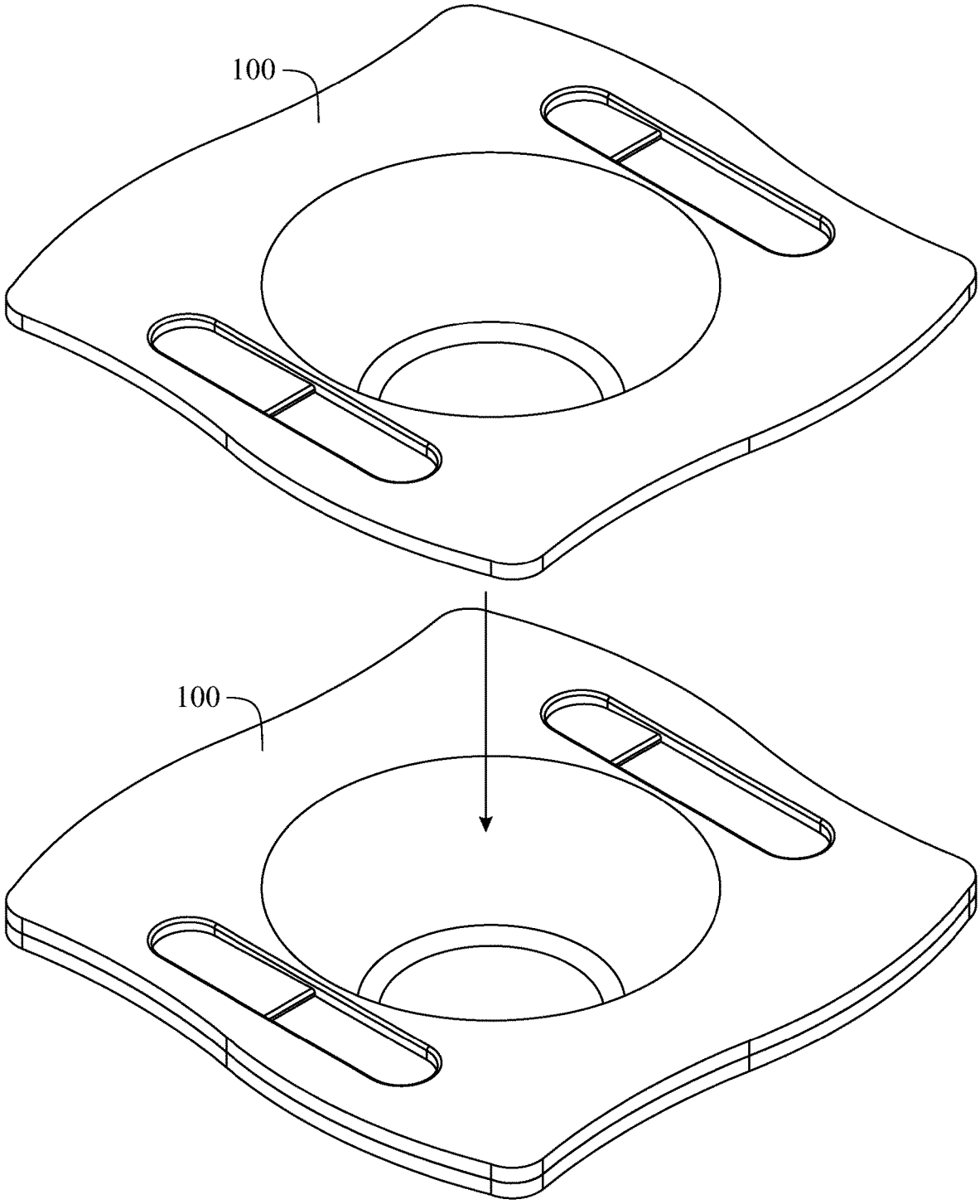
FIG. 4 presents a plurality of exemplary dishware comprising an elevating base and a plurality of receptacles for flatware, the dishware being stacked, in accordance with aspects of the present disclosure.
Figure 5:
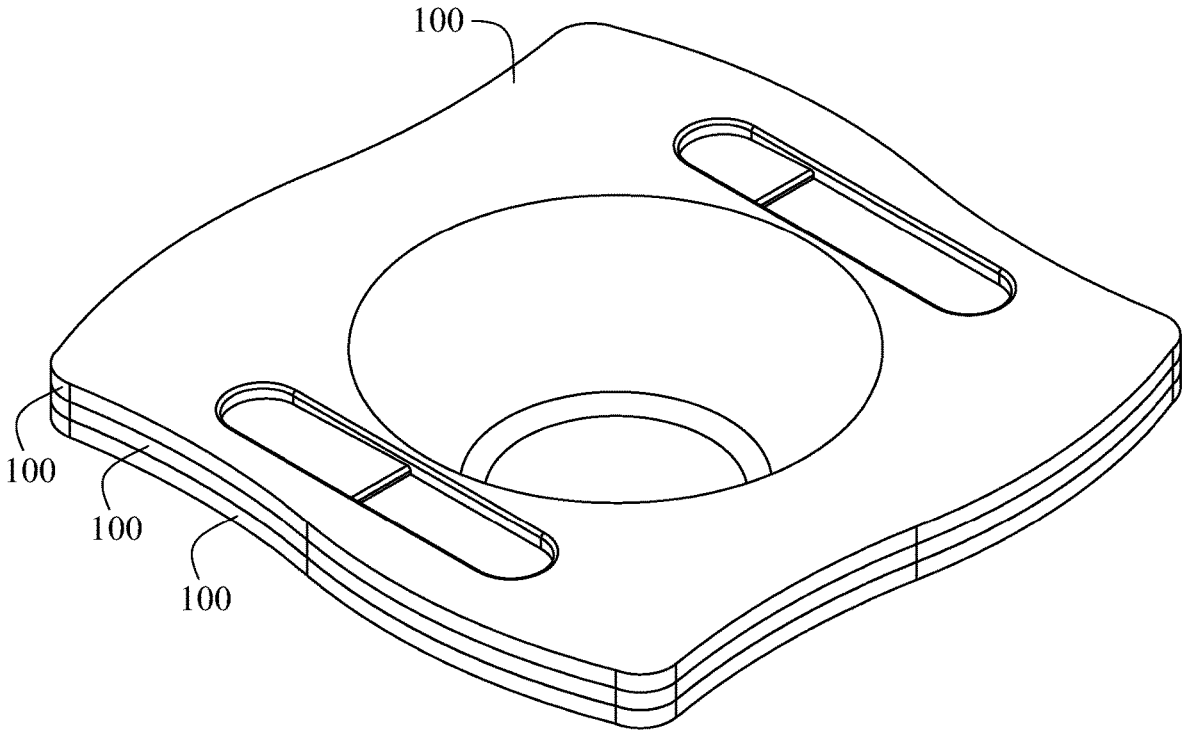
FIG. 5 presents a plurality of dishware comprising an elevating base and a plurality of receptacles for flatware, the dishware having been stacked, in accordance with aspects of the present disclosure.

FIGS. 4 and 5 present a plurality of an example of a dishware combination comprising an elevating base and a plurality of receptacles for various flatware. Shown in the figures are a single dishware combination and a plurality of dishware combinations stacked within or on top of each other. The figures depict a preferred manner in which such dishware combinations may be designed so that they may be arranged for convenient storage.

Figure 6:
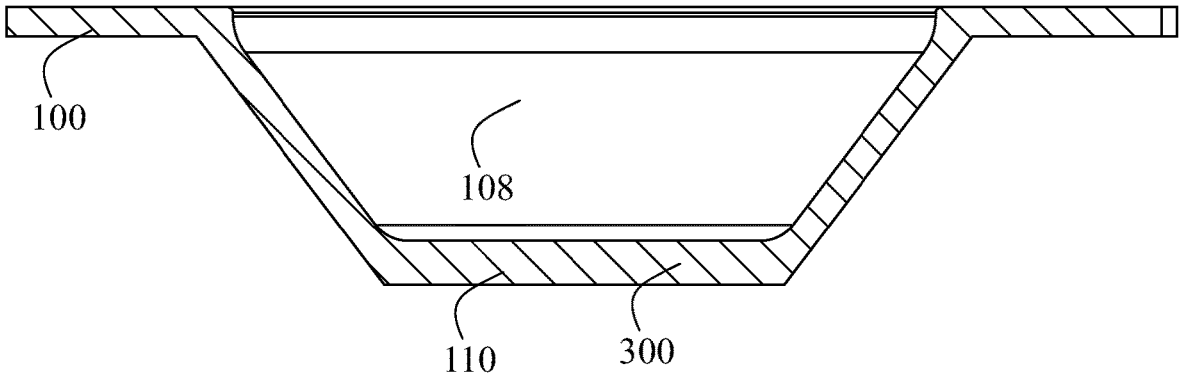
FIG. 6 presents a cross-sectional side elevation view through plane 6-6 of FIG. 2 of dishware comprising an elevating base and a plurality of receptacles for flatware, in accordance with aspects of the present disclosure.
Figure 7:
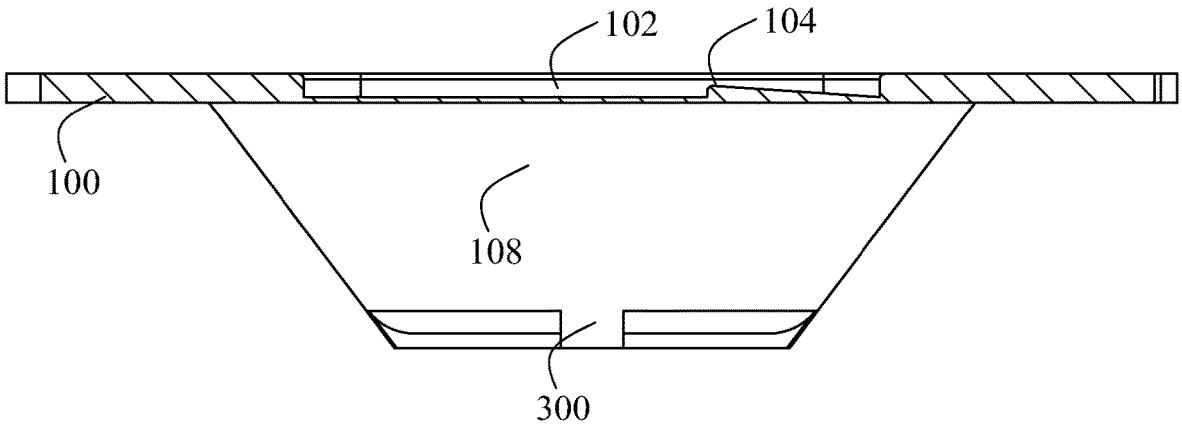
FIG. 7 presents a cross-sectional side elevation view through plane 7-7 of FIG. 2 of dishware comprising an elevating base and a plurality of receptacles for flatware, in accordance with aspects of the present disclosure.

FIGS. 6 and 7 present a hemi-sectioned side perspective view of a first example of a dishware combination comprising an elevating base and a plurality of receptacles for various flatware. Shown in the figures are the relative orientations of the plurality of components comprising the present dishware combination. While the relative orientation of such plurality of components may remain constant throughout the various examples discussed above, their relative sizes and shapes may vary as appropriate to suit the specific type of dishware combination intended.

The above described examples may be configured such that the flatware rests 104 include a step, bump or raised portion that matches a shape of an eating utensil near a working end of the eating utensil. For example, as shown in FIG. 1, a working end of a knife 104 is slightly elevated compared to a handle of the knife 104, and the step, bump or raised portion may match an elevation of the working end such that the knife snugly rests in the receptacle 104. The step, bump or raised portion can be more clearly seen in FIG. 7.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. Elevated dishware having flatware receptacles, comprising:

a main body;

one or more horizontal flatware receptacles; and an elevating base wherein the flatware receptacles include a raised flatware rest within the receptacles that supports a working end of a flatware item placed in a flatware receptacle of the receptacles such that the working end of the flatware item is elevated compared to a handle of the flatware item; and wherein the elevating base has interconnected projections forming an "X" shape where at least two of the projections are interconnected by a non-curved surface.

2. The dishware of claim 1, wherein the flatware receptacles are located on a planar top surface of the main body.

3. The dishware of claim 1, wherein the elevating base includes one or more projections extending from a bottom surface of the main body.

4. Elevated dishware having flatware receptacles, comprising:

a main body;

one or more horizontal flatware receptacles; and an elevating base;

wherein the flatware receptacles are located on a planar top surface of the main body; and wherein the flatware receptacles include a raised flatware rest within the receptacles that supports a working end of a flatware item placed in a flatware receptacle of the receptacles such that the working end of the flatware item is elevated compared to a handle of the flatware item; and wherein the elevating base generally has interconnected projections forming an "X" shape, where at least two of the projections are interconnected by a non-curved surface.

5. Elevated dishware having flatware receptacles, comprising:

a main body;

one or more horizontal flatware receptacles; and an elevating base; and wherein the elevating base includes one or more projections extending from a bottom surface of the main body; and wherein the flatware receptacles include a raised flatware rest within the receptacles that supports a working end of a flatware item placed in a flatware receptacle of the receptacles such that the working end of the flatware item is elevated compared to a handle of the flatware item; and wherein the elevating base generally has interconnected projections forming an "X" shape, where at least two of the projections are interconnected by a non-curved surface.

6. The dishware of claim 5, wherein the flatware receptacles are located on a planar top surface of the main body.

7. The dishware of claim 5, wherein the flatware receptacles include a flatware rest that supports a curve of a flatware item placed in the flatware receptacle.

* * * * *